US007938699B2

(12) United States Patent
Okano

(10) Patent No.: US 7,938,699 B2
(45) Date of Patent: May 10, 2011

(54) TERMINAL FITTING WITH A BENT PIECE WITH A LOCKING PROJECTION TAPERING TOWARDS ITS FRONT

(75) Inventor: Tomoki Okano, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 12/765,062

(22) Filed: Apr. 22, 2010

(65) Prior Publication Data

US 2010/0273366 A1 Oct. 28, 2010

(30) Foreign Application Priority Data

Apr. 24, 2009 (JP) ..... 2009-106652

(51) Int. Cl.
*H01R 4/10* (2006.01)

(52) U.S. Cl. ..... 439/877

(58) Field of Classification Search ..... 439/877, 439/595, 374, 852, 891
See application file for complete search history.

(56) References Cited

U.S. PATENT DOCUMENTS 4,979,912 A * 12/1990 Shindo et al. ..... 439/595
6,623,313 B1 9/2003 Ichida et al.
6,729,904 B2 5/2004 Nankou et al.
6,733,346 B2 5/2004 Tsuji et al.
6,752,660 B2 6/2004 Fujita et al.
6,790,085 B2 9/2004 Nankou et al.
6,796,836 B2 9/2004 Ichida et al.
6,817,904 B2 11/2004 Ishikawa et al.
6,851,976 B2 2/2005 Ichida et al.
6,953,358 B2 10/2005 Ichida et al.
7,048,582 B2 5/2006 Tabata et al.
7,108,550 B2 9/2006 Murakami et al.
2002/0142655 A1* 10/2002 Nimura et al. ..... 439/595
2003/0228798 A1* 12/2003 Nankou et al. ..... 439/595
2005/0090161 A1* 4/2005 Murakami et al. ..... 439/894
2005/0227551 A1* 10/2005 Tabata et al. ..... 439/852
2008/0293300 A1* 11/2008 Katsuma ..... 439/595
2009/0117773 A1* 5/2009 Shimizu ..... 439/374

* cited by examiner

*Primary Examiner* — Chandrika Prasad
(74) *Attorney, Agent, or Firm* — Gerald E. Hespos; Michael J. Porco

(57) ABSTRACT

A terminal fitting (10) is inserted into a housing (60) from behind and includes a tubular connecting portion (11), with which a mating terminal (90) is connectable from front. A bent piece (27) including both front and rear edges (28, 29) is formed at a position of a peripheral wall of the connecting portion (11) behind the front end of the connecting portion (11). The bent piece (27) is formed with a locking projection (32) to be retained and locked in the connector housing (60) by being bent toward an outer side over the entire length in forward and backward directions. The front end surface of the locking projection (32) is a curved surface receding toward the back.

18 Claims, 6 Drawing Sheets

TERMINAL FITTING WITH A BENT PIECE WITH A LOCKING PROJECTION TAPERING TOWARDS ITS FRONT

BACKGROUND OF THE INVENTION

1. Field of the Invention

The invention relates to a terminal fitting.

2. Description of the Related Art

Japanese Unexamined Patent Publication No. 2004-14304 discloses a conventional terminal fitting that can be inserted into a cavity formed in a connector housing. The terminal fitting includes a rectangular tubular connecting portion with which a mating terminal is connectable by being inserted from the front. A resiliently deformable locking lance projects from an inner surface of the cavity, and a locking projection is formed on a peripheral wall of the connecting portion for engagement with the locking lance. The terminal fitting is retained in the cavity by engaging the locking lance with the locking projection. The locking projection is formed by hammering out the rear end edge of a front side of peripheral wall to define a substantially conical shape pointed toward the front end.

The retaining reliability of the terminal fitting can be increased by increasing an area of engagement of the locking projection with the locking lance, i.e. increasing a projecting amount of the locking projection. However, an attempt to increase the projecting amount of the locking projection requires the peripheral wall to be hammed to a greater extent and thins the locking projection by that much, thereby causing a problem of reducing the rigidity of the locking projection. In other words, the thickness of the peripheral wall restricts a degree of freedom in forming the locking projection in the prior art.

The invention was developed in view of the above situation and an object thereof is to increase a degree of freedom in forming a locking projection.

SUMMARY OF THE INVENTION

The invention relates to a terminal fitting to be inserted into a housing of a connector. The terminal fitting includes a connecting portion with which a mating terminal is connectable from the front. A bent piece is formed at a position of a peripheral wall of the connecting portion behind the front end of the connecting portion. The bent piece includes front and rear edges and is formed with at least one locking projection to be retained and locked in the housing. More particularly, the bent piece is bent toward an outer side over substantially its entire length in forward and backward directions. Accordingly, a large area of engagement can be ensured without being restricted by the thickness of the peripheral wall and a degree of freedom in forming the locking projection is increased. The bent piece, therefore, differs from the prior art where the locking projection is formed by hammering the peripheral wall.

The front and rear ends of the locking projection are defined by the front and rear edges of the bent piece. Hence, the bent piece is easier to form than the hammered locking projection of the prior art.

The locking projection is behind the front end of the peripheral wall of the connecting portion. Thus, the length of the locking projection in forward and backward directions need not be extended even if a locking partner in the housing is at a rear position.

The front end surface of the locking projection preferably is a curved surface receding toward the back. Thus, the front end of the locking projection is not likely to damage the interior of the housing by the locking projection when the terminal fitting is inserted into the housing. Further, the curved shape of the locking projection can be formed easily as the bent piece is bent.

The locking projection preferably is inserted and guided along an insertion groove extending substantially in forward and backward directions in the housing when the terminal fitting is in a proper orientation. However, an insertion movement of the locking projection into the insertion groove is prevented when the terminal fitting is in a wrong insertion posture. Thus, the locking projection also functions as a stabilizer, and the construction can be simplified as compared with the case where the locking projection and a stabilizer are formed separately.

At least one guide for guiding the mating terminal into the connecting portion may be formed at a front end opening of the connecting portion and widens toward an outer side. The locking projection may be arranged behind the guide. Thus, the locking projection and the guide do not interfere with each other. Further, a height increase of the terminal fitting can be avoided, for example, by causing the locking projection and the guide to overlap in a height direction.

A protection wall may be provided for substantially closing a bottom end portion of a front surface of the connecting portion and is formed by being bent at a front end of a bottom plate of the terminal fitting.

A rear edge of the locking projection may be a substantially mountain-shaped lance receiving portion defined by the rear edge of the bent piece.

The lance receiving portion may be formed so that both base ends thereof substantially face the distal end corners of the front end of the locking lance when the terminal fitting is inserted properly into the housing.

The bent piece in a developed state may project substantially in the width direction from a side plate of the connecting portion and may be slightly inclined forward toward its projecting end via two bending lines extending in forward and backward directions over the entire length of the bent piece. A part between the bending lines preferably gradually narrows toward the front.

The locking projection may have the substantially same constant thickness as the connecting portion in its entirety.

The locking projection may include a tip with a projecting amount that gradually increases from the front end toward the rear end. Base portions may be widened toward the opposite widthwise sides with a downward or inward inclination from the tip portion.

These and other features of the invention will become more apparent upon reading the following detailed description of preferred embodiments and accompanying drawings. Even though embodiments are described separately single features thereof may be combined to additional embodiments.

DETAILED DESCRIPTION OF THE PREFERRED EMBODIMENTS

A terminal fitting 10 in accordance with the invention is identified by the numeral 10 in FIGS. 1 to 6. The terminal fitting 10 is to be inserted into a housing 60 from behind and is connected electrically with a mating terminal 90 by connecting the housing 60 with an unillustrated mating housing. An end of the connector to be connected with the mating connector is referred to as the front.

Figure 4:
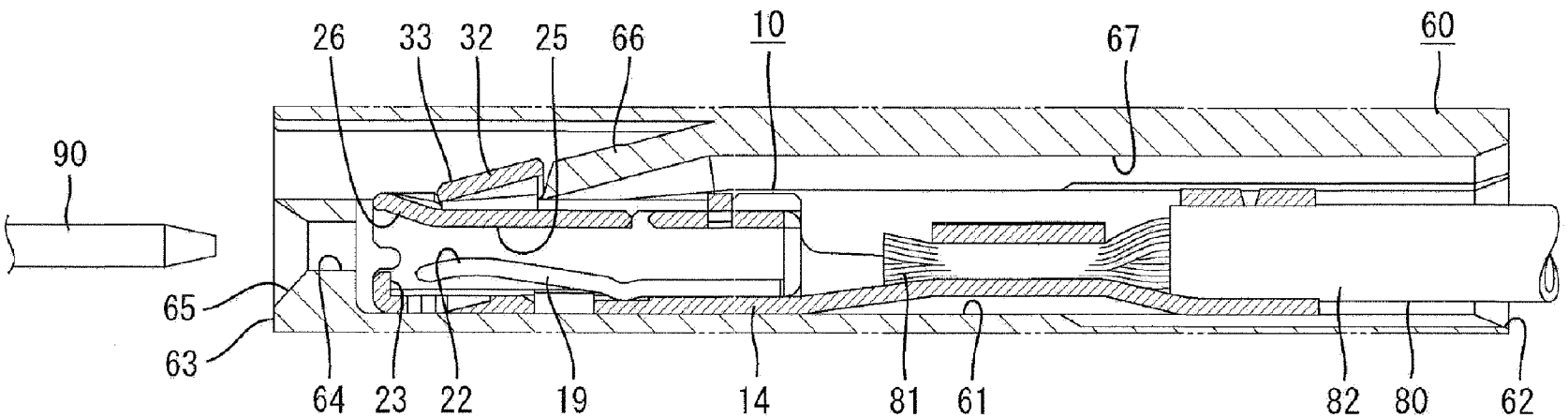
FIG. 4 is a section of the terminal fitting inserted in a housing.

The housing 60 is made e.g. of synthetic resin and internally formed with at least one cavity extending in forward and backward directions as shown in FIG. 4. The rear surface of the cavity 61 is substantially open to serve as an insertion opening 62, through which the terminal fitting 10 is to be at least partly inserted from behind, and the front surface of the cavity 61 is at least partly closed by a front wall 63 which can prevent the terminal fitting 10 from moving any further forward. The front wall 63 is formed with a first tab insertion opening 64, through which the tab-shaped mating terminal 90 is to be at least partly inserted from front.

A tapered tab guiding surface 65 is formed around the first tab insertion opening 64 in the front surface of the front wall 63 and is widened toward the front. A resiliently deformable locking lance 66 is formed at an inner surface of the cavity 61 at a height position above the first tab insertion opening 64. An insertion groove 67 is formed in the housing 60 for receiving a locking projection 32. The insertion groove 67 communicates with the cavity 61 and extends substantially in forward and backward directions to make an opening in the rear surface of the housing 60. The locking lance 66 is cantilevered obliquely down and in toward the front, and can be engaged resiliently with the terminal fitting 10 properly inserted into the cavity 61 to retain the terminal fitting 10.

Figure 5:
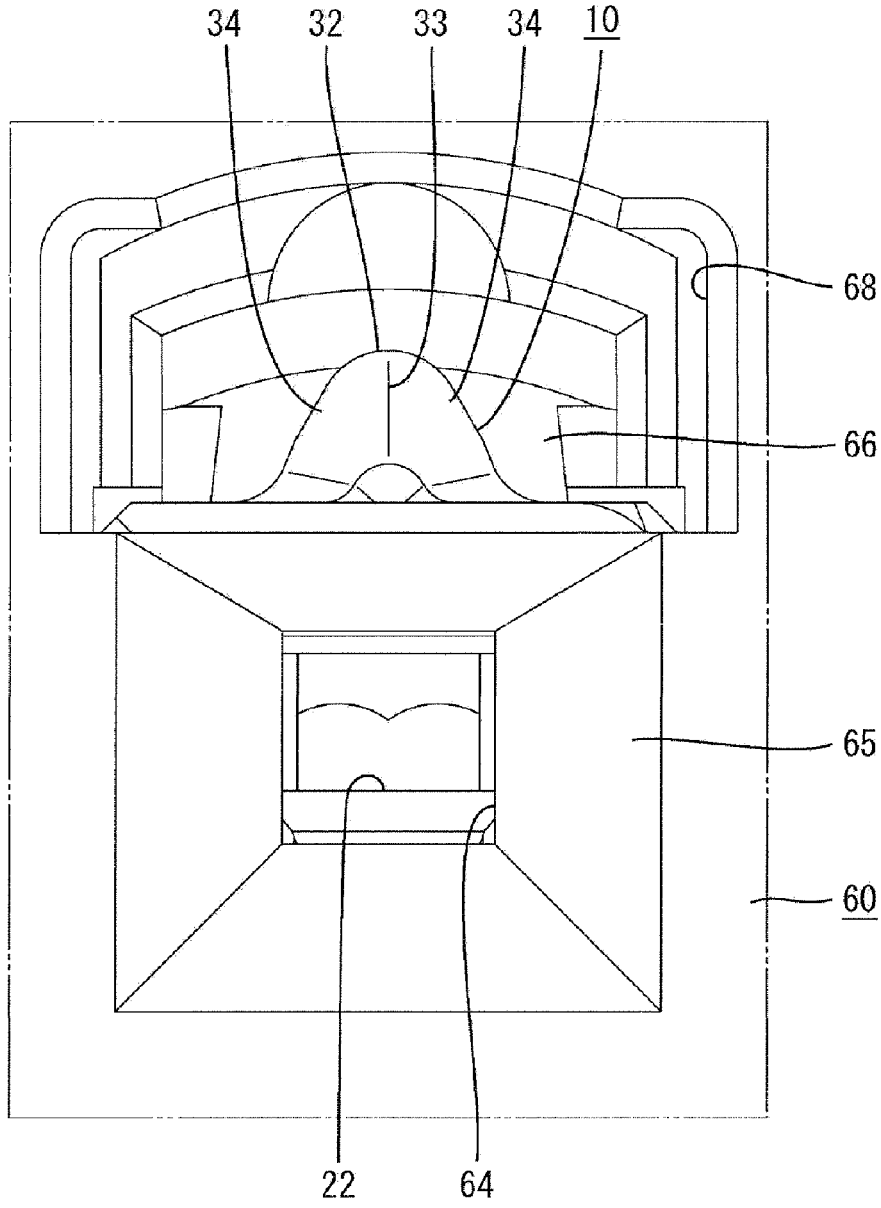
FIG. 5 is a front view of the terminal fitting inserted in the connector housing.

As shown in FIG. 5, a mold removal hole 68 left by the passage of a mold upon forming the locking lance 66 is formed in the front surface of the housing 60. The lower edge of the mold removal hole 68 is defined by the upper edge of the tab guiding surface 65.

Figure 1:
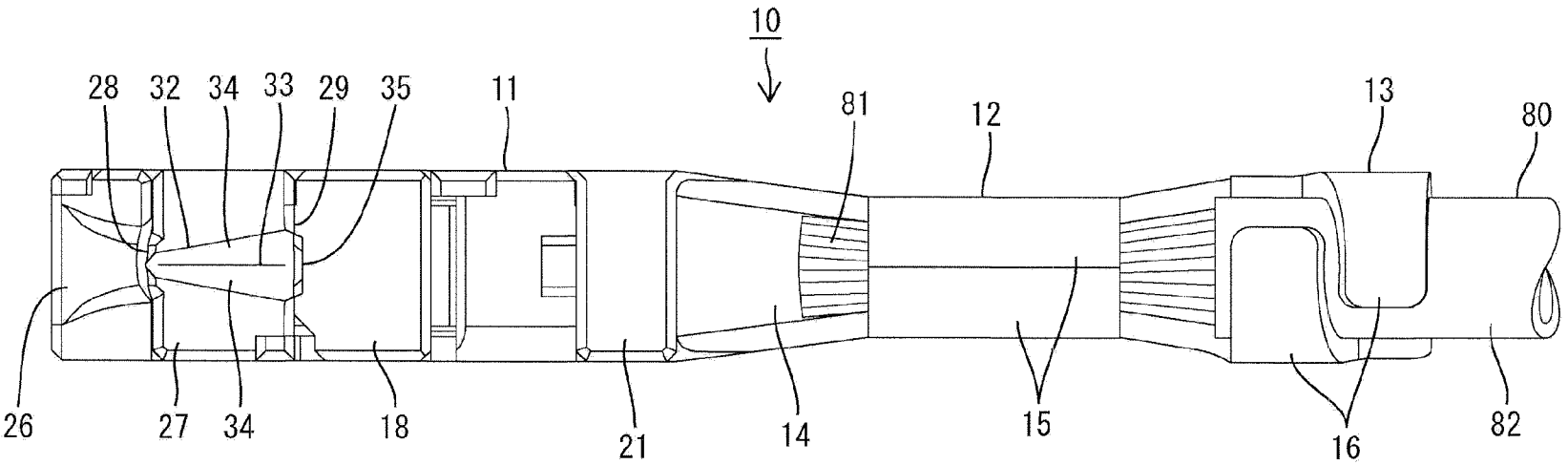
FIG. 1 is a plan view of a terminal fitting according to one embodiment.
Figure 2:
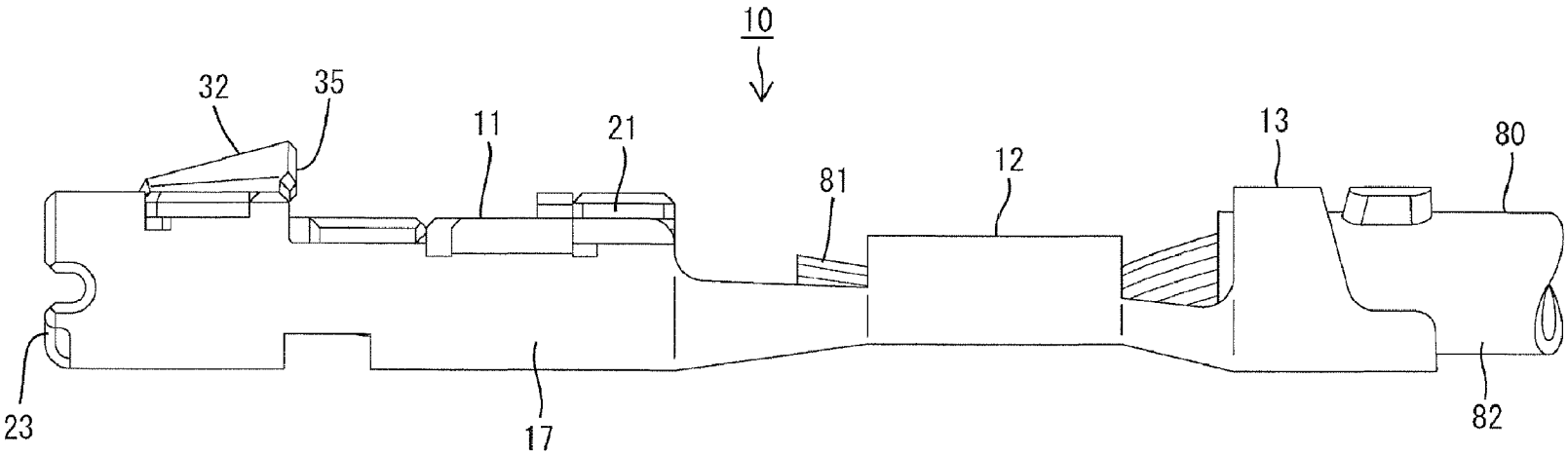
FIG. 2 is a side view of the terminal fitting.

The terminal fitting 10 is formed unitarily by bending, folding and/or embossing an electrically conductive metal plate to define a female terminal fitting. As shown in FIGS. 1 and 2, the terminal fitting 10 has opposite front and rear ends. A rectangular tubular connecting portion 11 is formed at the front end of the terminal fitting 10 and is configured to receive the mating terminal 90 from the front. A wire connection portion is rearward of the connecting portion 11 and has at least one wire connection barrel 12 that can be crimped, bent or folded into connection with a core 81 of a wire 80 exposed by peeling off an end portion of an insulation coating 82. The wire connection portion also has at least one insulation barrel 13 rearward of the wire connection barrel 12 and configured to be crimped, bent or folded into connection with the insulation coating 82 near an end of the wire 80.

A strip-like bottom plate 14 extends in forward and backward directions along the connecting portion 11 and the wire connecting portion. An end of the wire 80 is placed on a portion of the upper or inner surface of the bottom plate 14 along the wire connecting portion. Two opposed crimping pieces 15 project from opposite sides of the bottom plate 14 along the wire barrel 12 and can be wrapped partly around the core 81 so that projecting ends of the wire crimping pieces 15 butt against each other. Two insulation crimping pieces 16 project from opposite sides of the bottom plate 14 along the insulation barrel 13 at longitudinally displaced positions and can be wrapped around the insulation coating 82.

Figure 3:
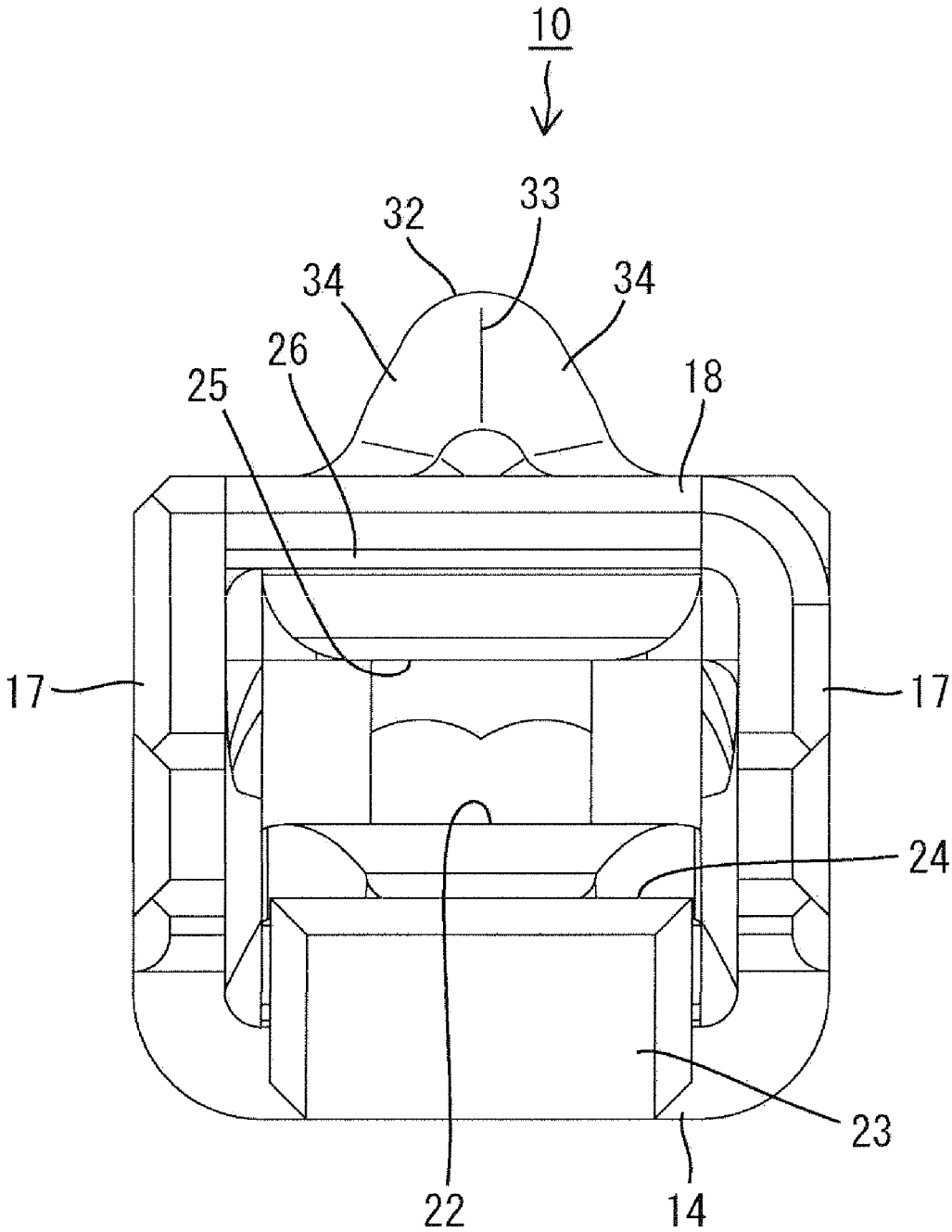
FIG. 3 is a front view of the terminal fitting.

The connecting portion 11 includes two side plates 17 that stand at substantially right angles from the opposite lateral sides of the bottom plate 14 to face each other in the width direction. A ceiling plate 18 is bent at a substantially at a right angle from one of the side plates 17 to extend toward the upper end of the other side plate 17 and to face the bottom plate 14, as shown in FIG. 3.

As shown in FIG. 4, the rear of the connecting portion 11 is closed by a wall bent down at a substantially right angle at the rear end of the ceiling plate 18. This wall is bent further at a substantially right angle to form a resilient contact piece 19 cantilevered forward substantially along the upper surface of the bottom plate 14. The resilient contact piece 19 has a mountain-shaped or pointed front end portion spaced from the upper surface of the bottom plate 14. The resilient contact piece 19 is resiliently displaceable in a vertical direction (intersecting an insertion and withdrawal direction of the terminal fitting 10 into and from the cavity 61) with the rear end thereof as a support. A contact 22 is formed on the tip of the front end portion of the resilient contact piece 19 and can be brought into electrical contact with the mating terminal 90.

As shown in FIG. 1, a pressing piece 21 is bent at a substantially right angle from the second side plate 17 to extend toward the upper end of the first side plate 17 and is placed on the rear end of the ceiling plate 18 to prevent displacement of the rear end of the ceiling plate 18. As shown in FIG. 3, a protection wall 23 is bent up and in at a substantially right angle from the front end of the bottom plate 14 for closing a bottom part of the front surface of the connecting portion 11. A second tab insertion opening 24 is formed in the front surface of the connecting portion 11 above the protection wall 63 and substantially coaxial with the first tab insertion opening 64. Thus, the mating terminal 90 can be inserted through the aligned tab insertion openings 24 and 64. The contact portion 22 of the resilient contact piece 19 can be seen through the second tab insertion opening 24 when the terminal fitting 10 is viewed from front.

A receiving portion 25 projects in from the ceiling plate 18 at a position facing the contact portion 22 of the resilient contact piece 19. The mating terminal 90 is sandwiched resiliently between the receiving portion 25 and the resilient contact piece 19. A guide 26 is formed at the front end of the receiving portion 25 and widens toward the front.

As shown in FIG. 1, a bent piece 27 is bent at a substantially right angle from the second side plate 17 of the connecting portion 11 to extend toward the upper end of the first side plate 17 and is placed on the ceiling plate 18. Thus, the guide 26 has a single-plate structure, whereas the ceiling plate 18 and the bent piece 27 define a double-plate structure. The bent piece 27 has a front edge 28 that extends in the width direction at a position behind the front end of the connecting portion 11. The bent piece 27 also has a rear edge 29 that extends in the width direction at a position before the front edge of the pressing piece 21. The rear edge 29 and the pressing piece 21 are substantially parallel and spaced apart. Specifically, the front and rear edges 28, 29 of the bent piece 27 are formed over the entire width of the connecting portion 11, with the front edge 28 at a position corresponding to the rear end of the guide 26 and the rear edge 29 at a position slightly before a midpoint of the connecting portion 11 in forward and backward directions. In other words, the bent piece 27 is above the receiving portion 25.

Figure 6:
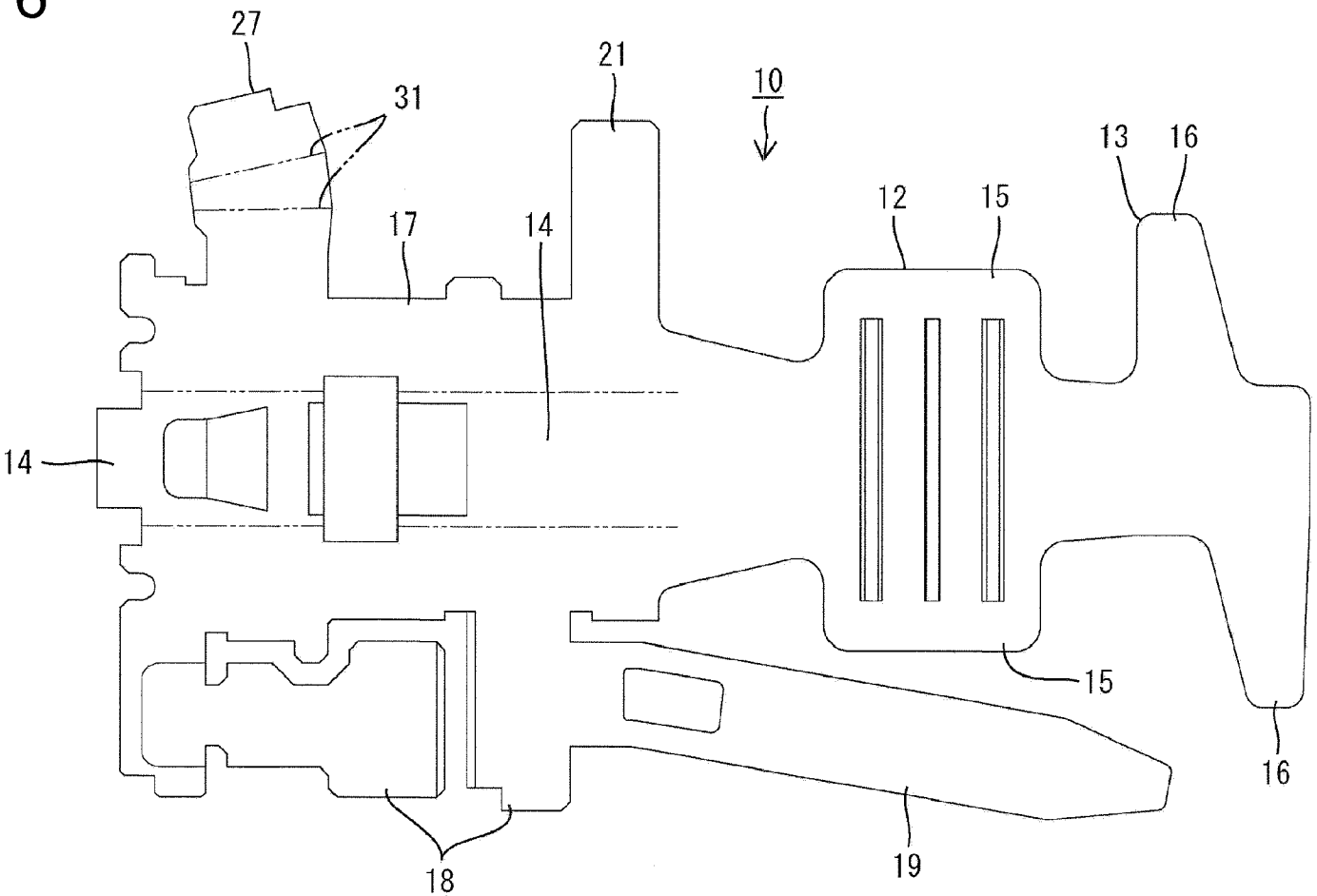
FIG. 6 is a development view of the terminal fitting.

As shown in FIG. 6, the bent piece 27 in a developed state projects from the second side plate 17 substantially in the width direction and inclines slightly forward toward its projecting end via two bending lines 31 that extend in forward and backward directions over the entire length of the bent piece 27. A part between the bending lines 31 becomes gradually narrower toward the front. The bent piece 27 can be bent out along the bending lines 31 to form a locking projection 32 that bulges convexly to define a substantially conical or trunco-conical shape. The locking projection 32 has the same constant thickness as the connecting portion 11 in its entirety. The front edge of the locking projection 32 substantially coincides with the front edge 28 of the bent piece 27 and the rear edge of the locking projection 32 substantially coincides with the rear edge 29 of the bent piece 27. Specifically, the locking projection 32 has a tip 33 with a projecting amount that gradually increases from the front end toward the rear end and bases 34 that widen toward the opposite widthwise sides with a downward inclination from the tip 33. Thus, the locking projection 32 has a substantially triangular plan view that narrows toward the front.

The front surface of the locking projection 32 is curved by the tip 33 and the bases 34 and practically includes no edge. The guide 26 is located immediately before the front edge 28 of the locking projection 32, and the front end of the locking projection 32 and the guide 26 partly overlap in the height direction. On the other hand, the rear edge of the locking projection 32 is a substantially mountain-shaped lance receiving portion 35 defined by the rear edge 29 of the bent piece 27. The front end of the locking lance 66 engages the lance receiving portion 35 to retain the terminal fitting 10 in the cavity 61. The lance receiving portion 35 stands up substantially vertically.

The connecting portion 11 is bent and embossed into a substantially rectangular tubular shape and the bent piece 27 is bent along the two bending lines 31 to narrow toward a widthwise center, thereby forming the locking projection 32. Further, the wire barrel 12 and the insulation barrel 13 are crimped, bent, folded or deformed and connected to the end portion of the wire 80 and, in this state, the terminal fitting 10 and the wire 80 is inserted into the cavity 61 of the housing 60 from behind and through the insertion opening 62.

The locking projection 32 is fit in and inserted along the insertion groove 67 to guide the terminal fitting 10 into the cavity 61. The locking projection 32 will not correspond to the insertion groove 67 and will contact the rear surface of the connector housing 60 if the terminal fitting 10 is in a vertically inverted posture to prevent insertion of the terminal fitting 10 into the cavity 61. Further, the locking projection 32 interferes with and deforms the locking lance 66 during insertion of the terminal fitting 10.

The locking projection 32 moves beyond the locking lance 66 when the terminal fitting 10 is inserted properly into the cavity 61, and the locking lance 66 is restored resiliently so that the front end of the locking lance 66 engages the lance receiving portion 35 of the locking projection 32 from behind, as shown in FIG. 4. At this time, bottom end corners of the front end of the locking lance 66 face the base ends of the lance receiving portion 35. The housing 60 then is connected with the mating housing. As a result, the mating terminal 90 enters the connecting portion 11 through the first and second tab insertion openings 64, 24 and the mating terminal 90 resiliently touches the contact portion 22 of the resilient contact piece 19 to connect the terminal fittings 10, 90 electrically.

As described above, the peripheral wall of the connecting portion 11 has the bent piece 27 that is bent to form the locking projection 32 for resiliently engaging the locking lance 66 in the cavity 61 of the housing 60. Thus, unlike the conventional case where the locking projection 32 is formed by hammering the peripheral wall, a large area of engagement can be ensured without being restricted by the thickness of the peripheral wall. As a result, a degree of freedom in forming the locking projection 32 is increased.

If the front end of the locking projection 32 was at the same position as the front end of the connecting portion 11, the lance receiving portion 35 would have to be more rearward to correspond to the locking lance 66. Thus, the length of the locking projection 32 in forward and backward directions would become longer and the locking projection 32 would be more difficult to form by bending. Further, if the front end position of the locking projection 32 was at an intermediate position of the bent piece 27, the front end position of the bending would not be determined and the locking projection 32 would be difficult to form by bending.

However, the locking projection 32 of the invention has the front and rear edges 28, 39 at positions behind the front end of the peripheral wall of the connecting portion 11. Thus, the locking projection 32 is not enlarged in forward and backward directions and the front and rear ends of the locking projection 32 are determined by the front and rear edges 28, 29 of the bent piece 27 so that the locking projection 32 is easier to form by bending.

The front end surface of the locking projection 32 is curved and recedes toward the back. Thus, the locking projection 32 will not damage the inner surface of the cavity 61, the locking lance 66 and the like when the terminal fitting 10 is inserted into the cavity 61. In this case, the curved shape of the front end surface is formed easily as the bent piece 27 is bent.

Further, the locking projection 32 is inserted and guided along the insertion groove 67 if the terminal fitting 10 is in a proper posture, whereas an insertion movement of the locking projection 32 into the insertion groove 67 is prevented if the terminal fitting 10 is in a wrong insertion posture. In other words, since the locking projection 32 also functions as a stabilizer, the construction can be simplified as compared with the case where the locking projection 32 and a stabilizer are formed separately.

The locking projection 32 is arranged behind the guide 26 and is widened toward the outer side. Thus, the locking projection 32 and the guide 26 do not interfere with each other. Accordingly, the locking projection 32 and the guide 26 can overlap in the height direction to avoid a height increase of the terminal fitting 10.

The invention is not limited to the above described and illustrated embodiment. For example, the following embodiments are also included in the technical scope of the present invention.

The locking projection may be formed into a tunnel hollow in forward and backward directions by bending the bent piece over the entire length.

The rear edge of the locking projection may be arranged at the same position as the rear end of the connecting portion.

The resilient contact piece may be in the form of a cantilever extending backward from the front end or may be supported at both front and rear ends integral to the bottom plate.

The present invention is also applicable to a male terminal fitting in which a tab projects forward from a connecting portion.

What is claimed is:

1. A terminal fitting to be inserted into a housing and including a connecting portion having a front end that is connectable with a mating terminal and a rear end opposite the front end, the terminal fitting comprising:

a bent piece formed at a peripheral wall on the connecting portion behind the front end of the connecting portion, the bent piece including opposite front and rear edges; and a locking projection projecting unitarily out from the bent piece and extending over substantially an entire length of the bent piece between the opposite front and rear edges, the locking projection tapering to narrower widths and smaller projecting dimensions at positions closer to the front edge of the bent piece so that the locking projection defines a maximum width and a maximum projecting distance at the rear edge of the bent piece to be retained and locked in the housing.

2. The terminal fitting of claim 1, wherein the front end surface of the locking projection is a curved surface receding toward the back.

3. The terminal fitting of claim 1, wherein the locking projection is to be inserted and guided along an insertion groove extending substantially in forward and backward directions in the housing when the terminal fitting is in a proper insertion orientation while an insertion movement of the locking projection into the insertion groove is prevented when the terminal fitting is in a wrong insertion orientation.

4. The terminal fitting of claim 1, wherein at least one guide for guiding the mating terminal into the connecting portion is formed at a front end opening of the connecting portion and widens toward an outer side.

5. The terminal fitting of claim 4, wherein the locking projection is behind the guide.

6. The terminal fitting of claim 5, wherein a front end portion of the locking projection and the guide partly overlap in a height direction.

7. The terminal fitting of claim 1, wherein a protection wall is provided for substantially closing a bottom end portion of a front surface of the connecting portion and is bent from a front end of a bottom plate of the terminal fitting.

8. The terminal fitting of claim 1, wherein a rear edge of the locking projection is formed into a substantially mountain-shaped lance receiving portion defined by the rear edge of the bent piece.

9. The terminal fitting of claim 8, wherein the lance receiving portion is formed such that both base ends thereof substantially face the distal end corners of the front end of the locking lance when the terminal fitting is properly inserted into the housing.

10. A terminal fitting to be inserted into a housing and including a connecting portion having a front end that is connectable with a mating terminal and a rear end opposite the front end, the terminal fitting comprising:

a bent piece formed at a peripheral wall on the connecting portion behind the front end of the connecting portion, the bent piece including opposite front and rear edges; and the bent piece bent toward an outer side over substantially an entire length of the bent piece in forward and backward directions, the bent piece being formed with at least one locking projection to be retained and locked in the housing, wherein the bent piece in a developed state projects substantially in a width direction from a side plate of the connecting portion and is inclined forward toward a projecting end via two bending lines extending in forward and backward directions over an entire length of the bent piece, a part between the both bending lines being gradually narrower toward the front.

11. The terminal fitting of claim 1, wherein locking projection and the connecting portion have substantially equal thicknesses.

12. The terminal fitting of claim 1, wherein the locking projection includes a tip with a projecting amount that gradually increases from the front end toward the rear end and base portions widened toward opposite widthwise sides with a downward inclination from the tip.

13. A terminal fitting comprising: a rectangular tubular connecting portion having a front end that is connectable with a mating terminal and a rear end opposite the front end, the rectangular tubular connecting portion having a bottom plate, opposite first and second side plates extending from the bottom plate and a bent piece bent from the first side plate and extending toward the second side plate in a width direction, the bent piece including opposite front and rear edges, a locking projection projecting unitarily out on the bent piece in a direction away from the bottom plate, the locking projection being tapered up away from the bent piece at positions closer to the rear edge of the bent piece and being tapered to wider dimensions at positions closer to the rear edge of the bent piece.

14. The terminal fitting of claim 13, wherein the locking projection has a front end substantially at the front edge of the bent piece and a rear end substantially aligned with the rear edge of the bent piece.

15. The terminal fitting of claim 13, wherein at least one guide extends from the front end of the connecting portion toward the bent piece, the guide widening toward the side plates at positions closer to the bent piece.

16. The terminal fitting of claim 15, wherein a front end portion of the locking projection and the guide partly overlap in a height direction.

17. The terminal fitting of claim 14, wherein locking projection and the connecting portion have substantially equal thicknesses.

18. A terminal fitting to be inserted into a housing and including a connecting portion having a front end that is connectable with a mating terminal and a rear end opposite the front end, the terminal fitting comprising:

a bent piece formed at a peripheral wall on the connecting portion behind the front end of the connecting portion, the bent piece including opposite front and rear edges; and the bent piece bent toward an outer side over substantially an entire length of the bent piece in forward and backward directions, the bent piece being formed with at least one locking projection to be retained and locked in the housing, wherein a front end surface of the locking projection is a curved surface receding toward the rear edge, and the locking projection includes a tip with a projecting amount that gradually increases from the front end toward the rear end and base portions widened toward opposite widthwise sides with a downward inclination from the tip.

* * * * *